US011262678B2

(12) United States Patent
Maeda

(10) Patent No.: US 11,262,678 B2
(45) Date of Patent: Mar. 1, 2022

(54) FIXING DEVICE CAPABLE OF PREVENTING FOREIGN MATTER FROM CONTACTING A HEATER

(71) Applicant: SHARP KABUSHIKI KAISHA, Sakai (JP)

(72) Inventor: Tomohiro Maeda, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/136,458

(22) Filed: Dec. 29, 2020

(65) Prior Publication Data

US 2021/0223729 A1 Jul. 22, 2021

(30) Foreign Application Priority Data

Jan. 22, 2020 (JP) ..... JP2020-008514

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2053
USPC ..... 399/329
See application file for complete search history.

(56) References Cited

U.S. PATENT DOCUMENTS

| | | | | |
|---|---|---|---|---|
| 8,428,499 | B2 * | 4/2013 | Shinshi | G03G 15/2064 399/329 |
| 9,046,832 | B2 * | 6/2015 | Samei et al. | G03G 15/2053 |
| 9,400,465 | B2 * | 7/2016 | Eiki et al. | G03G 15/2017 |
| 9,606,483 | B2 * | 3/2017 | Ishida et al. | G03G 15/2053 |
| 2011/0116822 | A1 | 5/2011 | Takenaka et al. | |
| 2013/0136515 | A1 * | 5/2013 | Sahara | G03G 15/2053 399/329 |

FOREIGN PATENT DOCUMENTS

| | | |
|---|---|---|
| JP | 2011-028038 A | 2/2011 |
| JP | 2011-107252 A | 6/2011 |

* cited by examiner

*Primary Examiner* — William J Royer
(74) *Attorney, Agent, or Firm* — ScienBiziP, P.C.

(57) ABSTRACT

A fixing device includes an endless fixing film that can revolve, a contact member that comes into contact with an inner peripheral surface of the fixing film, a pressure roller that press-contacts the fixing film from an outside of the fixing film toward the contact member to form a fixing nip area between the fixing film and the pressure roller, a heater that heats the fixing film, and a reflective member that reflects light emitted from the heater toward the fixing film. A protective member that allows irradiation of the light to the fixing film is provided between the heater and the fixing film.

20 Claims, 11 Drawing Sheets

FIXING DEVICE CAPABLE OF PREVENTING FOREIGN MATTER FROM CONTACTING A HEATER

BACKGROUND OF THE INVENTION

Field of the Invention

The present invention relates to a fixing device and an image forming apparatus including same, such as a copying machine, a multifunction peripheral, a facsimile device, and a printer.

Description of the Background Art

A fixing device has been conventionally known, in which a contact member is brought into contact with the inner peripheral surface of an endless fixing film that can revolve, a fixing nip area is formed between the fixing film and a pressure roller by press-contacting the fixing film from the outside with the pressure roller, the fixing film is heated by a heater (heater lamp), and the light emitted from the heater is reflected by a reflective member toward the fixing film (see, for example, Japanese Unexamined Patent Application Publication No. 2011-028038 and Japanese Unexamined Patent Application Publication No. 2011-107252).

In such a fixing device, the heating source which is the heater, raises the temperature up to, for example, about 800° C., and thus it is necessary to prevent foreign matter from coming into contact with the heater.

In the fixing film, the end of the fixing film in the rotation axis direction is damaged due to the deviation in the rotation axis direction by the revolution movement. The inner surface of the fixing film is scraped by sliding with the contact member of the fixing film due to the pressure contact of the pressure roller, and foreign matter such as shavings of the fixing film is generated.

However, in the conventional configuration such as that described in Japanese Unexamined Patent Application Publication No. 2011-028038 and Japanese Unexamined Patent Application Publication No. 2011-107252, the heater is in an exposed state, and foreign matter such as a fragment of the fixing film may come into contact with the heater. In addition, when the fixing film is hard, it is possible that the heater is damaged by the impact of the fragment of the fixing film.

Therefore, an object of the present invention is to provide a fixing device and an image forming apparatus capable of effectively preventing foreign matter from coming into contact with a heater.

SUMMARY OF THE INVENTION

In order to solve the above problems, the fixing device according to the present invention includes an endless fixing film that can revolve, a contact member that comes into contact with an inner peripheral surface of the fixing film, a pressure roller that press-contacts the fixing film from an outside of the fixing film toward the contact member to form a fixing nip area between the fixing film and the pressure roller, a heater that heats the fixing film, and a reflective member that reflects light emitted from the heater toward the fixing film. A protective member that allows irradiation of the light to the fixing film is provided between the heater and the fixing film. In addition, the image forming apparatus according to the present invention includes the fixing device according to the present invention.

According to the present invention, it is possible to effectively prevent foreign matter from coming into contact with a heater.

DESCRIPTION OF THE PREFERRED EMBODIMENTS

Figure 1:
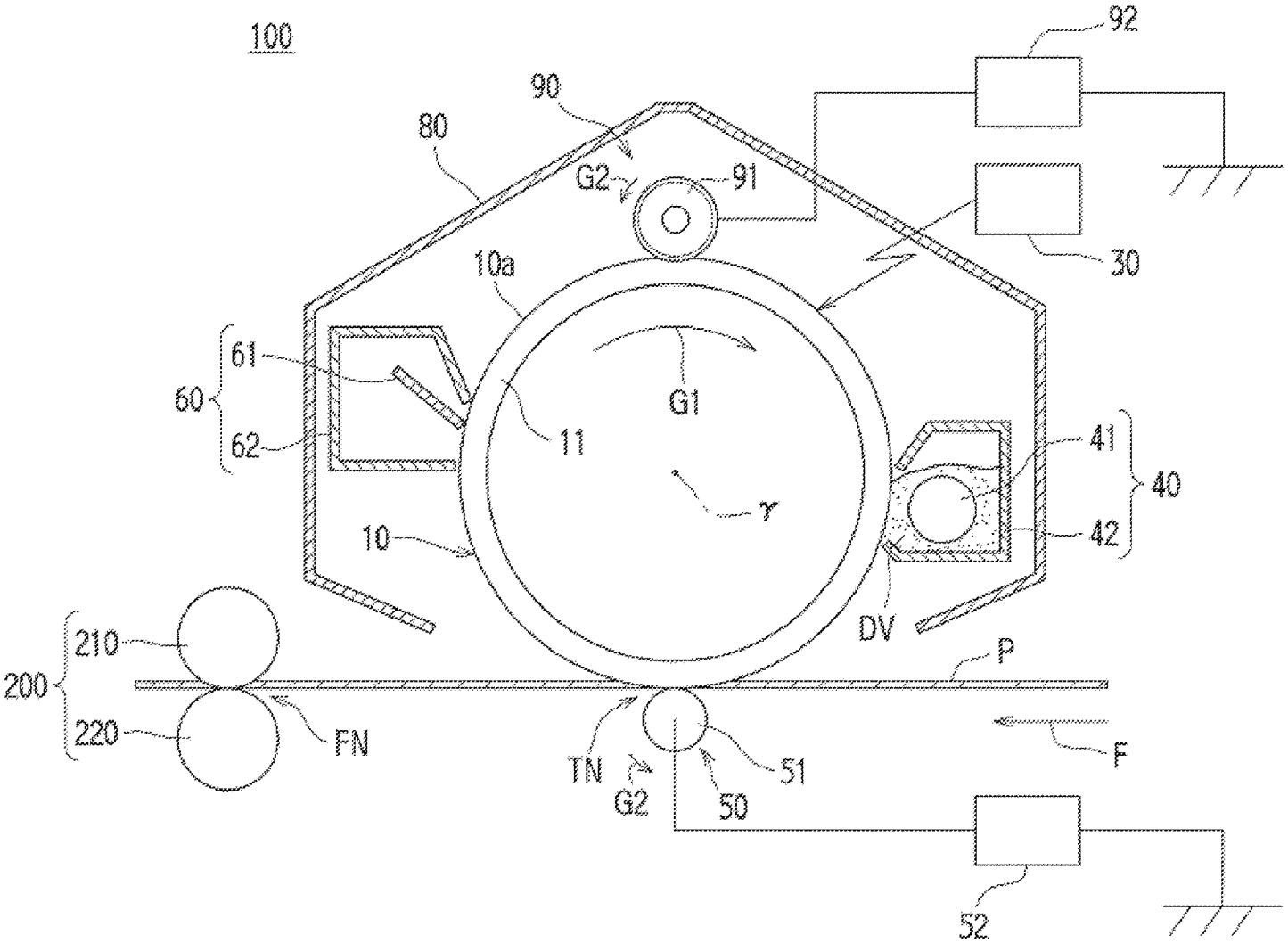
FIG. 1 is a cross-sectional view schematically illustrating an overview configuration of an image forming apparatus including a fixing device according to an embodiment of the present invention.

Hereinafter, an embodiment according to the present invention will be described with reference to the drawings. In the following description, the same components are designated by the same reference numerals. Their names and functions are the same. Therefore, the detailed description of the same components will not be repeated.

Image Forming Apparatus

FIG. 1 is a cross-sectional view schematically illustrating an overview configuration of an image forming apparatus 100 including a fixing device 200 according to an embodiment of the present invention.

As illustrated in FIG. 1, the image forming apparatus 100 includes a photoreceptor drum 10 acting as an image carrier, a charging device 90, an exposure device 30, a developing device 40, a transfer device 50, a cleaning device 60, and the fixing device 200. The charging device 90 charges a surface 10*a* of the photoreceptor drum 10. The exposure device 30 exposes the photoreceptor drum 10 charged by the charging device 90 to form an electrostatic latent image. The developing device 40 develops the electrostatic latent image formed by the exposure device 30 to form a toner image. The transfer device 50 transfers the toner image formed by the developing device 40 onto a recording medium P such as a recording paper. The cleaning device 60 removes and collects the toner remaining on the photoreceptor drum 10. The fixing device 200 fixes the toner image transferred by the transfer device 50 on the recording medium P conveyed in a conveyance direction F to form an image. In this example, the image forming apparatus 100 is a monochrome printer (specifically, a laser printer). The image forming apparatus 100 may be, for example, an intermediate transfer type color image forming apparatus capable of forming a color image. In addition, the image forming apparatus 100 is a printer in this example, but may be, for example, a copying machine, a multifunction peripheral, or a facsimile device.

In the photoreceptor drum 10, a substrate 11 is rotatably supported by a main body frame (not illustrated) of the image forming apparatus 100, and is rotationally driven by a driver (not illustrated) about a rotation axis y in a predetermined first rotation direction G1 (clockwise in the drawing).

The charging device 90 includes a charging member 91. The charging member 91 uniformly charges the surface 10*a* of the photoreceptor drum 10 to a predetermined potential by a high voltage applying device 92. In this example, the charging member 91 is a charging roller, and is driven to rotate in a second rotation direction G2 with respect to the rotation of the photoreceptor drum 10. The charging member 91 may be an electrostatic charging charger.

The exposure device 30 repeatedly scans the light modulated on the basis of image information, on the surface 10*a* of the photoreceptor drum 10 to be rotationally driven, in the rotation axis y direction of the photoreceptor drum 10, which is the main scanning direction. The developing device 40 includes a developing roller 41 and a developing tank 42. The developing roller 41 supplies a developer DV to the surface 10*a* of the photoreceptor drum 10. The developing tank 42 houses the developer DV. The transfer device 50 includes a transfer member 51. The transfer device 50 applies a predetermined high voltage to a transfer nip area TN formed between the photoreceptor drum 10 and the transfer device 50 by a high voltage applying device 52. In this example, the transfer member 51 is a transfer roller and is driven to rotate in the second rotation direction G2 with respect to the rotation of the photoreceptor drum 10. The transfer member 51 may be a transfer charger.

The cleaning device 60 includes a cleaning blade 61 and a collection casing 62. The cleaning blade 61 removes the toner remaining on the surface 10*a* of the photoreceptor drum 10. The collection casing 62 houses the toner removed by the cleaning blade 61. The fixing device 200 includes a heating fixer 210 (heat fixing unit) and a pressure roller 220. The pressure roller 220 forms a fixing nip area FN together with the heating fixer 210. The detailed configuration of the fixing device 200 will be described later. In addition, the image forming apparatus 100 further includes a housing 80 that houses the respective components of the image forming apparatus 100.

Fixing Device

Figure 2A:
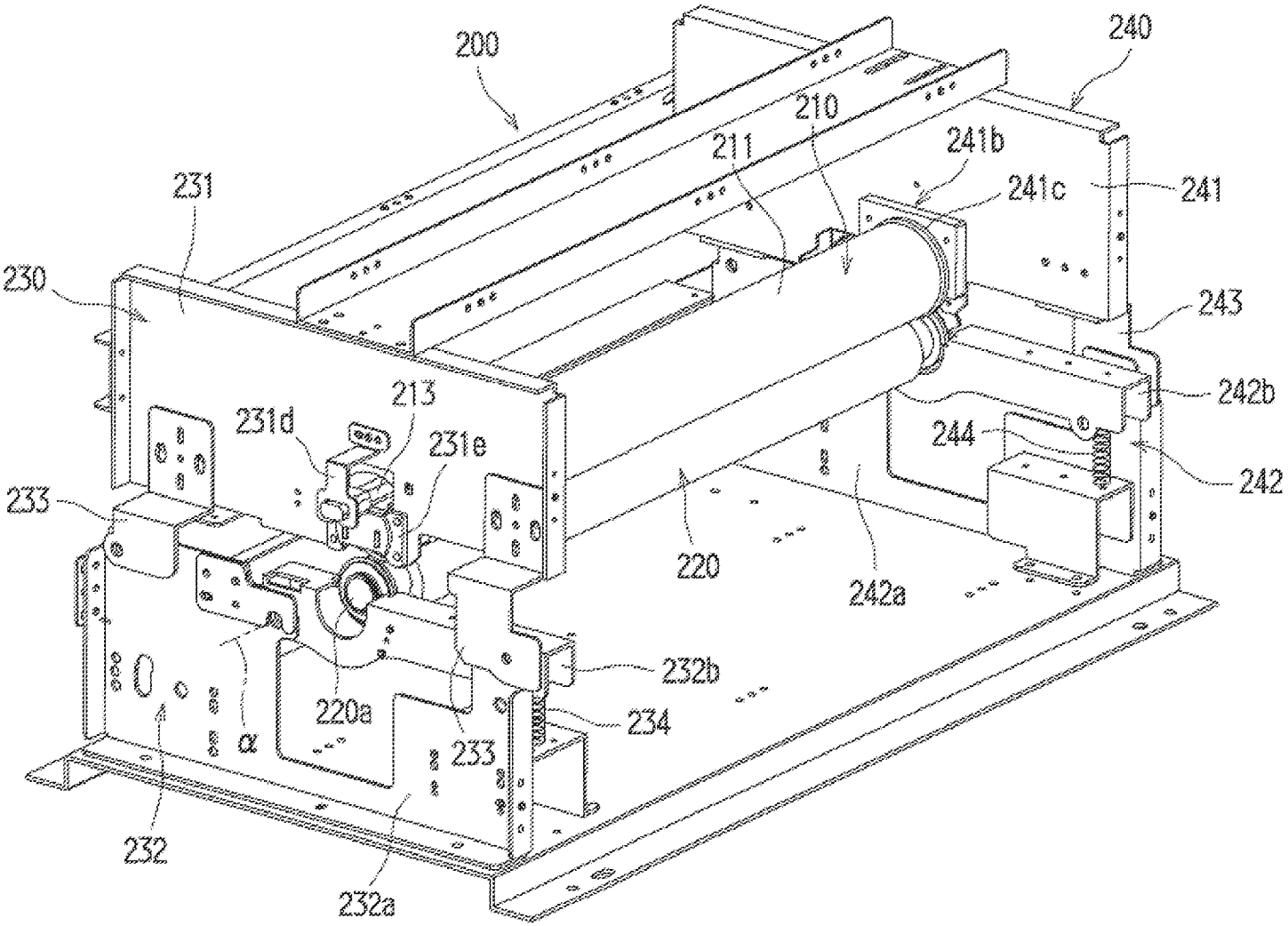
FIG. 2A is a perspective view of the fixing device in the image forming apparatus illustrated in FIG. 1 as viewed from diagonally above the front side.
Figure 2B:
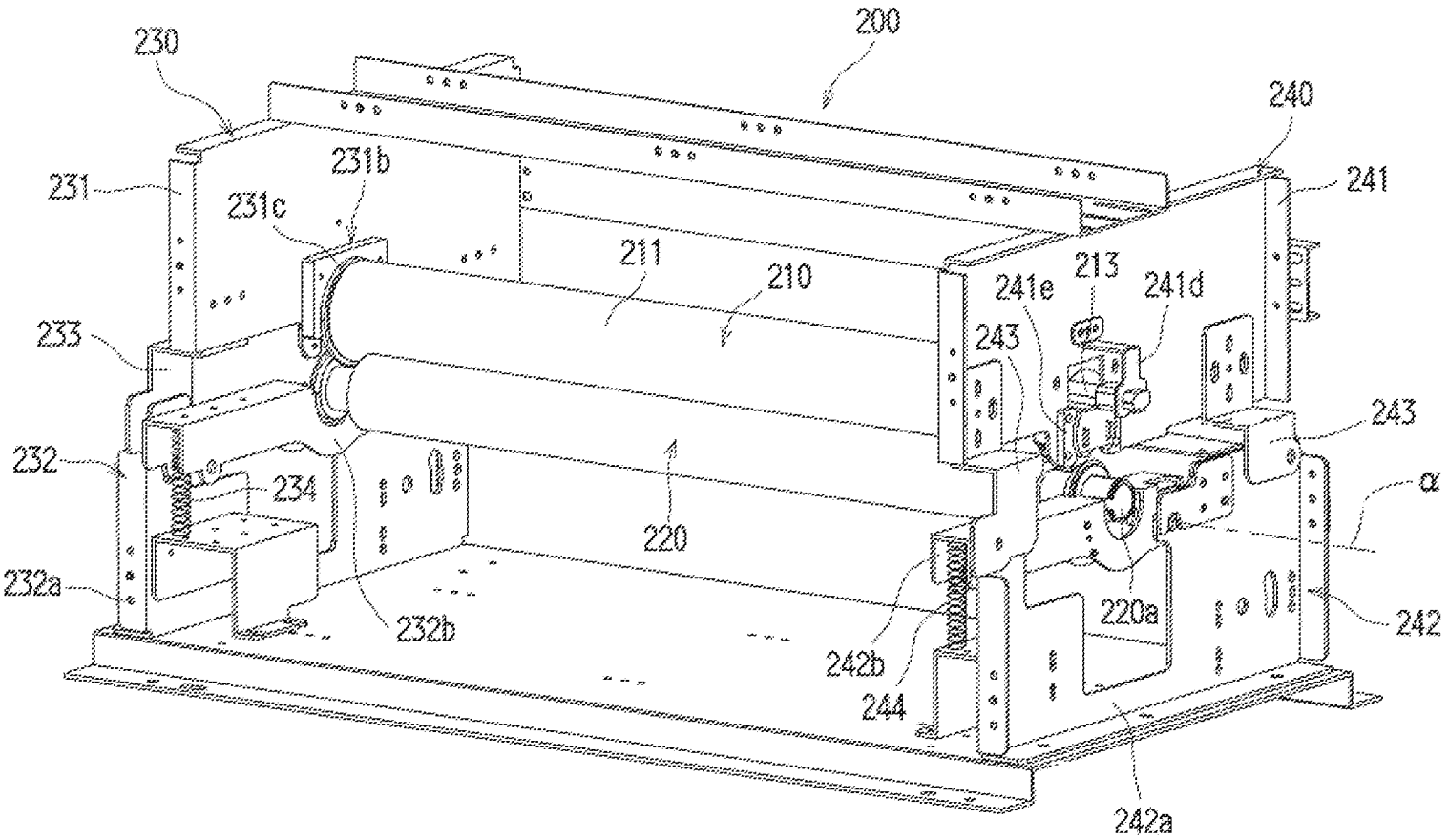
FIG. 2B is a perspective view of the fixing device in the image forming apparatus illustrated in FIG. 1 as viewed from diagonally above the back side.
Figure 3:
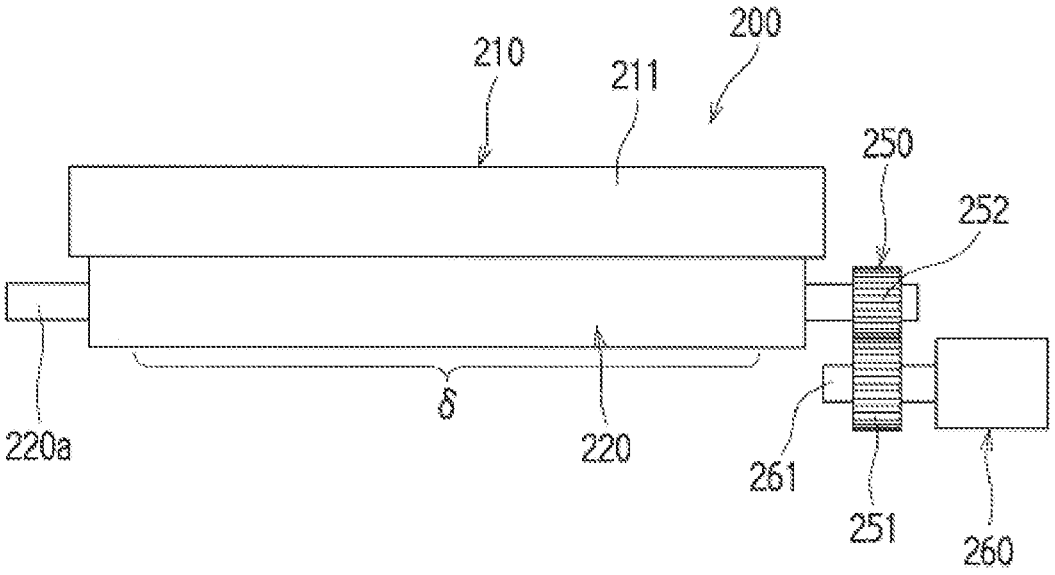
FIG. 3 is a schematic view schematically illustrating a drive system for a pressure roller in the fixing device illustrated in FIGS. 2A and 2B.
Figure 4A:
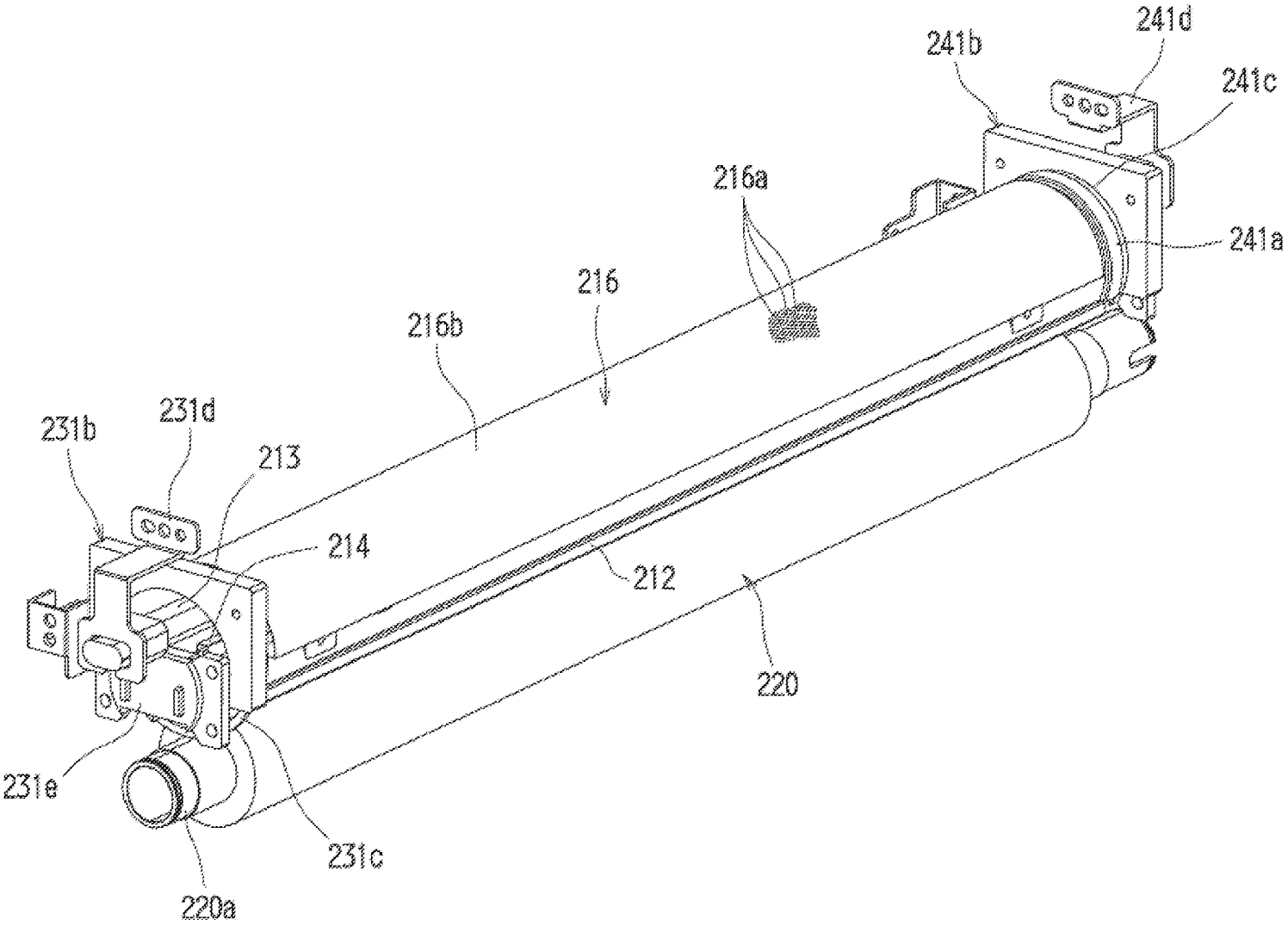
FIG. 4A is a perspective view of a heating fixer and a pressure roller portion in the fixing device illustrated in FIG. 2A in a state where a fixing film is removed, as viewed from diagonally above the front side.
Figure 4B:
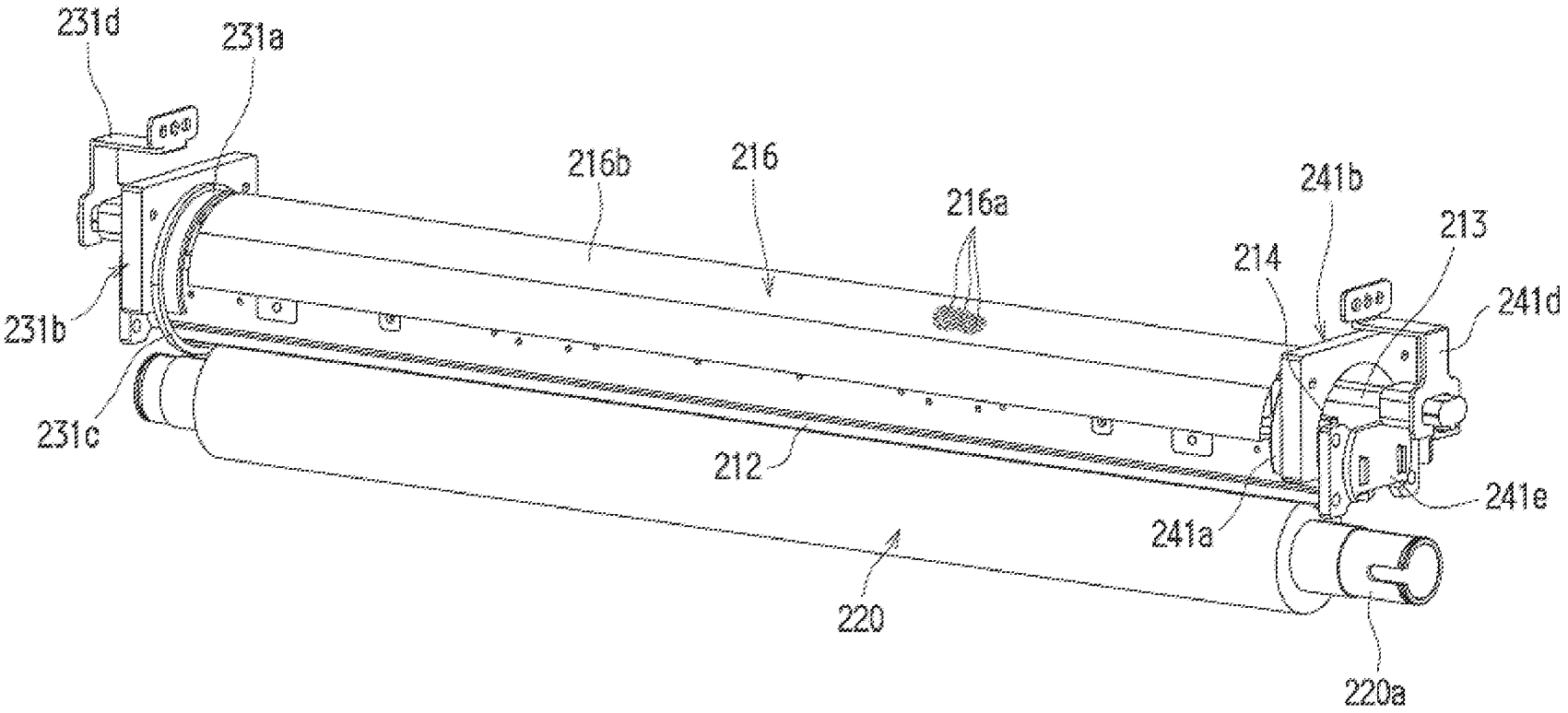
FIG. 4B is a perspective view of a heating fixer and a pressure roller portion in the fixing device illustrated in FIG. 2B in a state where a fixing film is removed, as viewed from diagonally above the back side.
Figure 5:
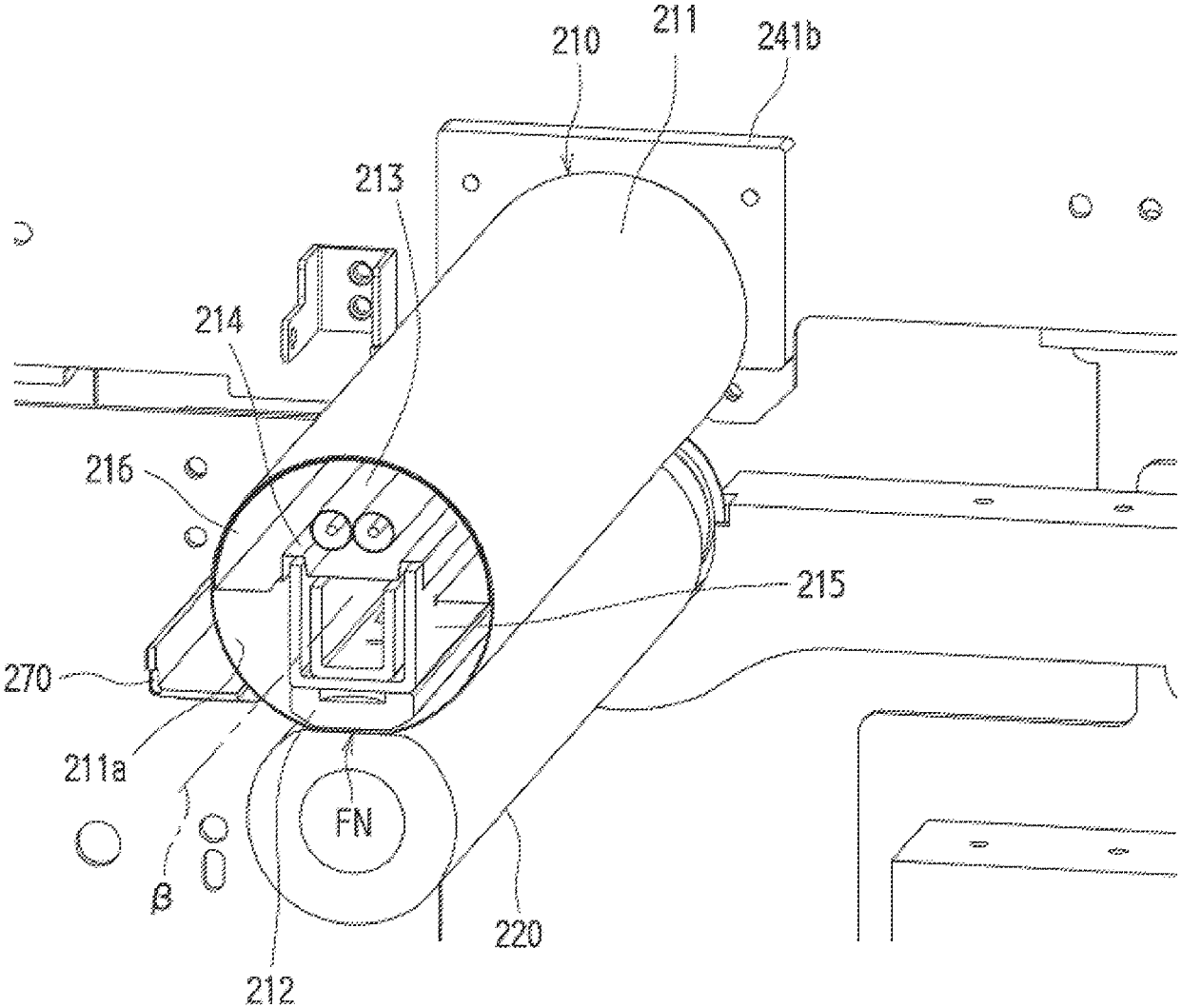
FIG. 5 is a perspective view illustrating a cross-sectional structure of the heating fixer and pressure roller portion in the fixing device.
Figure 6:
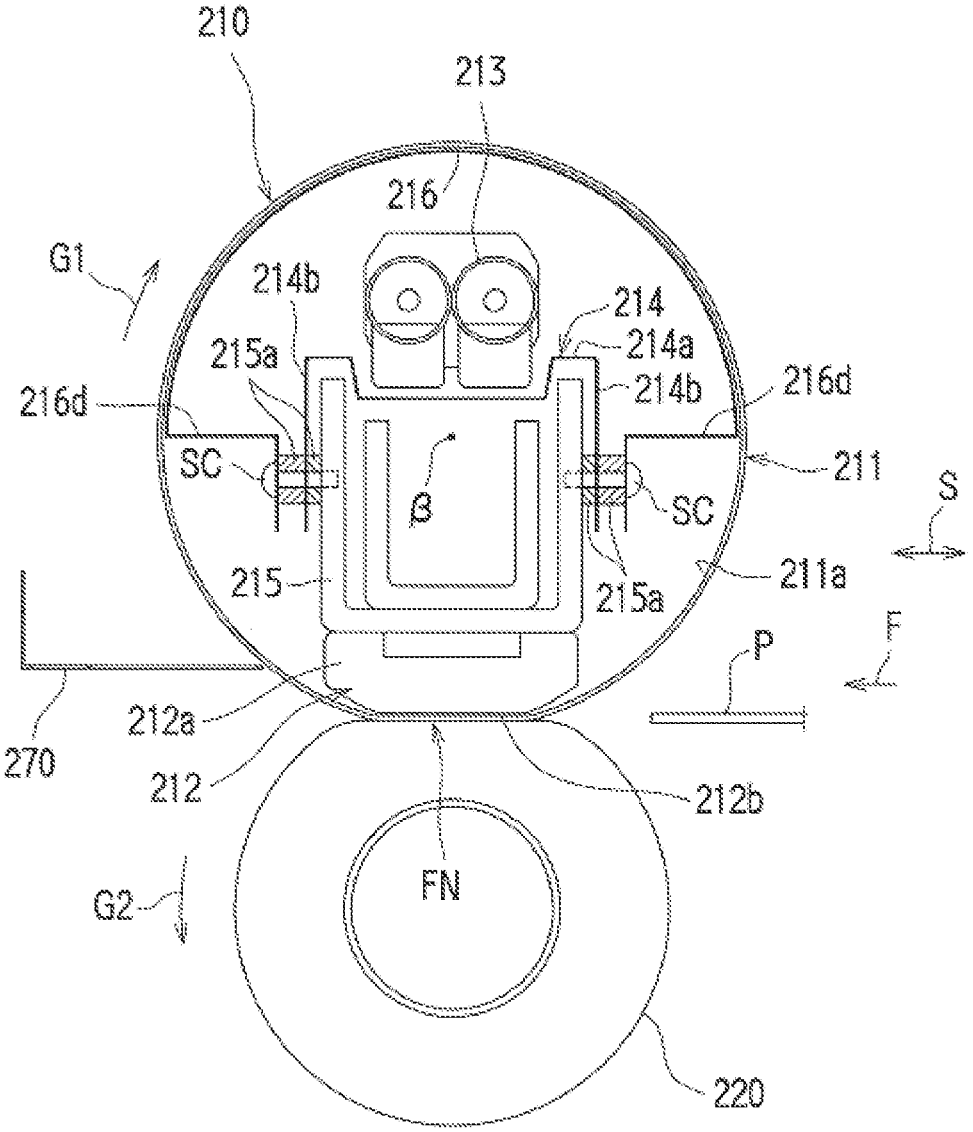
FIG. 6 is a cross-sectional view of the heating fixer and pressure roller portion in the fixing device.

FIGS. 2A and 2B are perspective views of the fixing device 200 in the image forming apparatus 100 illustrated in FIG. 1, as viewed from diagonally above the front side and diagonally above the back side, respectively. FIG. 3 is a schematic view schematically illustrating a drive system for the pressure roller 220 in the fixing device 200 illustrated in FIGS. 2A and 2B. FIGS. 4A and 4B are perspective views of the heating fixer 210 and pressure roller 220 portion in the fixing device 200 illustrated in FIGS. 2A and 2B in a state where a fixing film (a fixing belt) 211 is removed, as viewed from diagonally above the front side and diagonally above the back side, respectively. FIG. 5 is a perspective view illustrating a cross-sectional structure of the heating fixer 210 and pressure roller 220 in the fixing device 200. In addition, FIG. 6 is a cross-sectional view of the heating fixer 210 and pressure roller 220 in the fixing device 200.

As illustrated in FIGS. 2A and 2B, the fixing device 200 includes the heating fixer 210, the pressure roller 220, a front frame 230 (side plate), a rear frame 240 (side plate), and a peeling member 270. The front frame 230 includes a front upper frame 231, a front lower frame 232, and a coupler 233. The front upper frame 231 and the front lower frame 232 are vertically coupled by the coupler 233. The rear frame 240 includes a rear upper frame 241, a rear lower frame 242, and a coupler 243. The rear upper frame 241 and the rear lower frame 242 are vertically coupled by the coupler 243.

The heating fixer 210 includes the fixing film 211 (see FIGS. 2A, 2B, 5, and 6), a contact member 212 (see FIGS. 4A, 4B, 5, and 6), a heater 213, a reflective member 214 (see FIGS. 5 and 6), a holding member 215, and a protective member 216 (see FIGS. 4A, 4B, 5, and 6). The fixing film 211 is an endless (cylindrical) heat-resistant film (belt) that can revolve. The contact member 212 is in contact with an inner peripheral surface 211*a* of the fixing film 211. The heater 213 heats the fixing film 211 from the inside. The reflective member 214 reflects the light (particularly infrared rays) emitted from the heater 213 toward the fixing film 211. The holding member 215 holds the contact member 212.

The pressure roller 220 press-contacts the fixing film 211 from the outside toward the contact member 212 to form the fixing nip area FN between the fixing film 211 and the pressure roller 220.

The front upper frame 231 and the rear upper frame 241 revolvably support the front end and the rear end of the fixing film 211, respectively. The front upper frame 231 and the rear upper frame 241 are provided with a front support member 231*b* and a rear support member 241*b* including semi-ring-shaped sliding contact sections 231*a* and 241*a*, respectively. The sliding contact sections 231*a* and 241*a* are provided in such a manner that the sliding contact surface faces the side opposite to the fixing nip area FN. In the fixing film 211, the inside of both ends in the revolution axis ß (see FIGS. 5 and 6) is fitted to the outside of the sliding contact sections 231*a* and 241*a*. As a result, the fixing film 211 can revolve while the inner peripheral surface 211*a* is in sliding contact with the sliding contact surfaces of the sliding contact sections 231*a* and 241*a*. In addition, the front support member 231*b* and the rear support member 241*b* are provided with ring-shaped guide members 231*c* and 241*c*, respectively. As a result, when the guide members 231*c* and 241*c* move (shift) to one side or the other side in the revolution axis ß direction of the fixing film 211, the end of the fixing film 211 in the revolution axis ß direction comes in sliding contact with the guide member 231*c* and 241*c*, and the fixing film 211 thereby can be returned to the opposite side.

Examples of the fixing film 211 can include a fixing film in which a silicone rubber layer having a predetermined thickness (for example, approximately 100 to 300 μm) is formed on a metal or polyimide (PI) substrate having a predetermined thickness (for example, approximately 30 to 100 μm), and a fluororesin having a thickness (for example, approximately 20 to 30 μm) is further formed on the silicone rubber layer, specifically, a fixing film with a PFA tube on the upper layer of silicone rubber, or a fixing film with a fluororesin coated on the upper layer of silicone rubber.

As illustrated in FIG. 6, the contact member 212 includes a contact member main body 212*a* and a low friction resistance layer 212*b* provided on the surface of the contact member main body 212*a* on the pressure roller 220 side. Examples of the contact member main body 212*a* can include a main body formed of a heat-resistant resin material having rigidity (for example, a liquid crystal polymer) and a heat-resistant resin material having elasticity (for example, a rubber material). When a rigid contact member main body 212*a* is to have elasticity, an elastic layer (for example, a rubber layer such as silicone rubber) can be provided on the surface. Examples of the low friction resistance layer 212*b* include a glass fiber material (for example, glass cloth) coated with a fluororesin (for example, a glass cloth sheet).

The heater 213 includes a heater lamp. As illustrated in FIGS. 2A and 2B, the front end and the rear end of the heater 213 are fixed to the front upper frame 231 and the rear upper frame 241 via a front lamp supporter 231*d* and a rear lamp supporter 241*d*, respectively. The heater 213 raises the temperature up to, for example, close to 800° C.

In this example, the reflective member 214 is a plate-shaped member (reflective plate) which is bent in such a manner that a portion in which the heater 213 is provided in the central portion in a short direction S orthogonal to the revolution axis ß direction is recessed, and that both ends of the plate-shaped member face the fixing nip area FN side. The reflective member 214 is formed of a metal material such as aluminum. The reflective member 214 is a mirror-finished surface on the heater 213 side. As a result, the light emitted from the heater 213 can be efficiently irradiated to the fixing film 211. The reflective member 214 is fixed to the holding member 215. As illustrated in FIG. 6, the reflective member 214 includes a reflective member main body 214*a* and a support piece 214*b* fixed to the reflective member main body 214*a*. The support pieces 214*b* are provided on both side surfaces of the reflective member main body 214*a* in the short direction S. In this example, the reflective member main body 214*a* and the support pieces 214*b* are integrally formed. The support pieces 214*b* are fixed to the holding member 215 by a fixing member SC (screw) via intervening members 215*a*.

The holding member 215 is a sheet metal member obtained by bending both ends of a plate-shaped member in the short direction S orthogonal to the revolution axis β direction to the side opposite to the fixing nip area FN. The front end and the rear end of the holding member 215 are fixed to the front upper frame 231 and the rear upper frame 241 via a front holder 231*e* and a rear holder 241*e*, respectively.

The protective member 216 is provided between the heater 213 and the fixing film 211. The protective member 216 is a heat-resistant member having a configuration that allows the light emitted from the heater 213 and/or the light reflected from the reflective member 214 to be irradiated to the fixing film 211. The protective member 216 is provided with a large number of through holes 216*a* (see FIGS. 4A and 4B).

Examples of the protective member 216 include a fiber shaped material woven into a mesh (netted) shape, a belt-shaped material that has been punched to provide a large number of through holes 216*a*, and a belt-shaped material that has been drilled (punched) to provide a large number of through holes 216*a*. Examples of the fiber shaped material include metal materials such as stainless steel (SUS) and aluminum. Examples of the belt-shaped material include metal materials such as stainless steel (SUS) and nickel. The thickness of the protective member 216 is preferably small, preferably about 0.5 mm or less.

The protective member 216 is provided in such a manner that a facing surface facing 216*b* facing the fixing film 211 faces the side opposite to the fixing nip area FN. Bent portions 216*d* are formed at both ends of the protective member 216 in the short direction S. The bent portions 216*d* are bent inward from both ends of the protective member 216 in the short direction S. The protective member 216 is formed in a semicircular dome shape. The bent portions 216*d* are fixed to the holding member 215 by the fixing member SC (screw) via the intervening members 215*a*. The radius of the protective member 216 can be about 30 to 40 mm. The protective member 216 is provided at a position concentric with the center of the semi-ring-shaped sliding contact sections 231*a* and 241*a*, with a radius smaller than the radius of the semi-ring-shaped sliding contact sections 231*a* and 241*a* by a predetermined distance or more. Here, the predetermined distance can be a distance that does not come into contact with the fixing film 211 even if the fixing film 211 revolves, for example, about 0.1 to 1 mm (for example, 0.8 mm).

As illustrated in FIGS. 2A and 2B, the front lower frame 232 and the rear lower frame 242 include a front lower frame body 232*a* and a rear lower frame body 242*a*, and a front turning member 232*b* and a rear turning member 242*b*, respectively. The front turning member 232*b* and the rear turning member 242*b* are turnably supported about a turning axis a by a turning shaft (not illustrated) with respect to the front lower frame body 232*a* and the rear lower frame body 242*a*, respectively. The front turning member 232*b* and the rear turning member 242*b* rotatably support the front end and the rear end of a rotary shaft 220*a* of the pressure roller 220, respectively. The front turning member 232*b* and the rear turning member 242*b* are urged toward the fixing film 211 by urging members 234 and 244 (winding springs), respectively, in such a manner that the pressure roller 220 press-contacts the fixing film 211. As a result, the pressure roller 220 can press the fixing film 211.

The examples of the pressure roller 220 can include a pressure roller in which an elastic member (sponge rubber such as silicone rubber or rubber member such as solid rubber) having a predetermined thickness (for example, about 6 mm) and a hardness of about 35 to 40 degrees is provided on a metal substrate such as aluminum and a fluororesin is formed on the elastic member, specifically, a pressure roller with a PFA tube provided on an elastic member. In this example, the fluororesin is provided in a passage area 6 (see FIG. 3) of the recording medium P in the pressure roller 220. That is, the rubber member is exposed in an area other than the passage area 6 of the pressure roller 220 (for example, about 10 mm in each end area). As a result, in the both ends of the pressure roller 220, the driving (rotating) force from the pressure roller 220 can be easily transmitted to both ends of the fixing film 211. As a result, the rotation failure of the fixing film 211 can be effectively prevented.

As illustrated in FIG. 3, the pressure roller 220 is rotationally driven by a rotary driving force from a rotation driver 260 (drive motor) via a drive transmission mechanism 250. The drive transmission mechanism 250 includes a drive gear 251 and a driven gear 252. The drive gear 251 is fixed to the rotary shaft 261 of the rotation driver 260. The driven gear 252 is fixed to a rotary shaft 220*a* of the pressure roller 220 in a state of being meshed with the drive gear 251. As a result, the rotation driver 260 can rotationally drive the pressure roller 220 in the second rotation direction G2 via the drive transmission mechanism 250. A heater (heater lamp) may be provided inside the pressure roller 220.

The peeling member 270 is a peeling plate provided in the vicinity of the fixing film 211 on the downstream side of the fixing nip area FN in the first rotation direction G1 of the fixing film 211. As a result, it is possible to effectively prevent the recording medium P that has passed between the fixing film 211 and the pressure roller 220 from being wound around the fixing film 211.

Regarding the Present Embodiment

According to the present embodiment, since the protective member 216 is provided between the heater 213 and the fixing film 211, it is possible to effectively prevent foreign matter from coming into contact with the heater 213. Moreover, since the protective member 216 allows the fixing film 211 to be irradiated with light, it is possible to suppress a decrease in the efficiency for heating the fixing film 211 by the heater 213.

First Embodiment

In the present embodiment, the protective member 216 is provided with a large number of through holes 216*a*. In this way, the light emitted from the heater 213 and/or the light reflected from the reflective member 214 can be easily passed through with a simple configuration. Examples of the shape from a view of a plane of the through hole 216*a* can include a polygonal shape such as a quadrangle (diamond shape) and a hexagon (honeycomb shape), a circular shape, and an elliptical shape. Among them, the honeycomb structure can have the largest aperture ratio, and thus the amount of light that is emitted from the heater 213 and directly irradiated to the fixing film 211 can be increased. As the size of the through hole 216*a* becomes smaller, it becomes more difficult for foreign matter to enter the heater 213 side of the protective member 216. However, the amount of light that is emitted from the heater 213 and directly irradiated to the fixing film 211 decreases. Meanwhile, as the size of the through hole 216*a* becomes larger, it becomes easier for foreign matter to enter the heater 213 side of the protective member 216. However, the amount of light that is emitted from the heater 213 and directly irradiated to the fixing film 211 increases. Therefore, as the size of the through hole 216*a* (diameter for a circle, a maximum length for a non-circle), for example, about 0.5 mm to 1 mm can be exemplified.

In this example, the protective member 216 is formed in a mesh shape. In this way, the light emitted from the heater 213 and/or the light reflected from the reflective member 214 can be easily passed through with a simpler configuration.

Figure 7A:
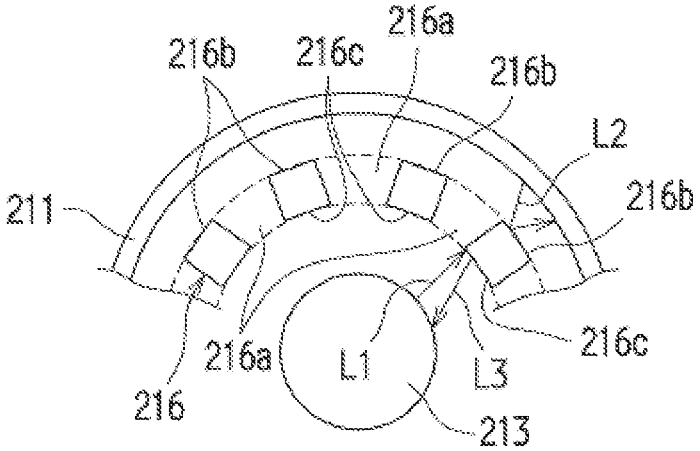
FIG. 7A is a cross-sectional view illustrating an exaggerated cross-sectional structure of an example of a protective member.
Figure 7B:
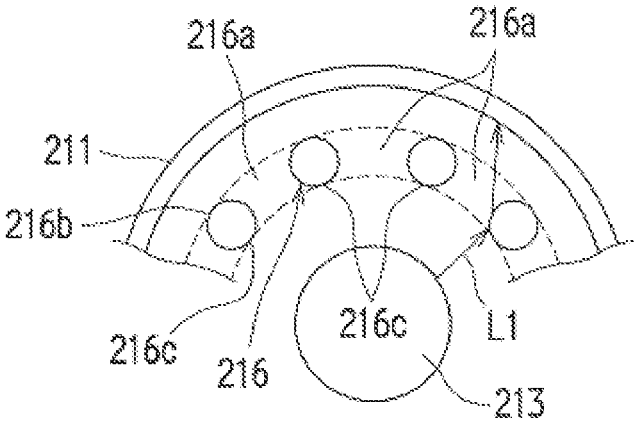
FIG. 7B is a cross-sectional view illustrating an exaggerated cross-sectional structure of an other example of the protective member.
Figure 7C:
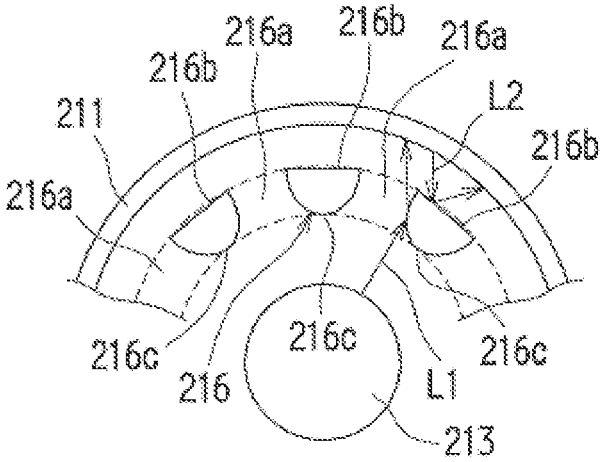
FIG. 7C is a cross-sectional view illustrating an exaggerated cross-sectional structure of yet another example of the protective member.

FIGS. 7A to 7C are cross-sectional views illustrating an exaggerated cross-sectional structure of an example, an other example, and yet another example of the protective member 216, respectively.

In the example illustrated in FIGS. 7A and 7C, in the protective member 216, the facing surface 216*b* between the plurality of through holes 216*a* on the side facing the fixing film 211 is formed in a flat surface. The normal line of the fixing film 211 passing through the central portion of the facing surface 216*b* in the circumferential direction is orthogonal to or substantially orthogonal to the facing surface 216*b*. In this way, a light L2 reflected from the fixing film 211 can be reflected by the flat facing surface 216*b* of the protective member 216 and returned to the fixing film 211 efficiently. It is possible to suppress a decrease in the efficiency for heating the fixing film 211 by the heater 213 by just that much.

As in the example illustrated in FIG. 7A, in the protective member 216, in a case where an opposite surface 216*c* between the plurality of through holes 216*a* on the side opposite to the fixing film 211 is formed as a flat surface, a light L1 emitted from the heater 213 is reflected by the opposite surface 216*c* in the protective member 216, and a light L3 reflected by the opposite surface 216*c* is likely to return to the heater 213.

In this respect, in the example illustrated in FIGS. 7B and 7C, in the protective member 216, the opposite surface 216*c* between the plurality of through holes 216*a* on the side opposite to the fixing film 211 is formed in a protruding curved surface. In this way, the light L1 emitted from the heater 213 can be reflected by the opposite surface 216*c* having a protruding curved surface in the protective member 216 and efficiently irradiated to the fixing film 211. By only this, it is possible to suppress a decrease in the efficiency for heating the fixing film 211 by the heater 213.

In the example illustrated in FIG. 7A, the cross-sectional shape between the plurality of through holes 216*a* is square, and one plane of the square shape faces the fixing film 211. In this way, it is possible to easily implement a configuration in which the facing surface 216*b* on the side facing the fixing film 211 between the plurality of through holes 216*a* of the protective member 216 is formed in a flat surface.

In the example illustrated in FIG. 7B, the cross-sectional shape between the plurality of through holes 216*a* is a circular shape. In this way, it is possible to easily implement a configuration in which the opposite surface 216*c* on the side opposite to the fixing film 211 between the plurality of through holes 216*a* of the protective member 216 is formed in a protruding curved surface.

In the example illustrated in FIG. 7C, the cross-sectional shape between the plurality of through holes 216*a* is a semicircular shape, and a plane on the side opposite to the semicircular shape faces the fixing film 211. In this way, it is possible to easily implement a configuration in which the facing surface 216*b* on the side facing the fixing film 211 between the plurality of through holes 216*a* of the protective member 216 is formed in a flat surface, and it is possible to easily implement a configuration in which the opposite surface 216*c* on the side opposite to the fixing film 211 between the plurality of through holes 216*a* of the protective member 216 is formed in a protruding curved surface.

In the present embodiment, at least a surface of the protective member 216 facing the fixing film 211 is formed of a high emissivity material having a higher emissivity than the emissivity of the reflective member 214. In this way, even if heat is absorbed on the opposite surface of the protective member 216 on the side opposite to the fixing film 211, the heat absorbed by the protective member 216 can be efficiently radiated to the fixing film 211 from the surface facing the fixing film 211 toward the inner surface of the fixing film 211 by the light emitted from the heater 213 and/or the light reflected from the reflective member 214. Examples of the high emissivity material include a material having an emissivity of 0.9 or more, specifically, an infrared radiation paint (manufactured by Okitsumo Incorporated).

When the protective member 216 comes into contact with the fixing film 211, at least one of the protective member 216 and the fixing film 211 is easily damaged. Moreover, heat unevenness is likely to occur in the fixing film 211 that is heated by the light emitted from the heater 213. Furthermore, when the protective member 216 comes into contact with the heater 213, the protective member 216 is damaged.

In this respect, in the present embodiment, the protective member 216 is in non-contact with both the heater 213 and the fixing film 211. In this way, the protective member 216 and the fixing film 211 can be made less likely to be damaged. Moreover, it is possible to suppress the occurrence of heat unevenness in the fixing film 211 that is heated by the light emitted from the heater 213.

When the protective member 216 is close to the heater 213, the protective member 216 is easily damaged by the heat of the heater 213.

In this respect, in the present embodiment, the protective member 216 is provided closer to the fixing film 211 than to the heater 213. In this way, it is possible to prevent the protective member 216 from being damaged by heat.

The protective member 216 may be provided so as to face the fixing film 211 by less than half a circumference of the fixing film 211. However, in this case, a phenomenon in which the temperature of the fixing film 211 locally becomes excessively higher than a specified temperature, so-called overshoot, is likely to occur. If so, inconvenience such as wrinkles of the fixing film 211 is likely to occur.

In this respect, in the present embodiment, the protective member 216 is provided so as to face the fixing film 211 by at least half a circumference of the fixing film 211. In this way, the occurrence of overshoot can be suppressed, and the occurrence of inconvenience such as wrinkles of the fixing film 211 thereby can be effectively prevented. Moreover, the fixing film 211 can be heated at a wide angle by the heater 213.

In the present embodiment, the heater 213 is provided between the reflective member 214 and the fixing film 211. In this way, the light reflected from the heater 213 to the reflective member 214 can be efficiently irradiated to the fixing film 211.

In the present embodiment, the heater 213 is provided on the side opposite to the fixing nip area FN with respect to the revolution axis ß of the fixing film 211. In this way, it is possible to perform a fixing process in the fixing nip area FN for the recording medium P in a state where the fixing film 211 is stably heated by the heater 213 and the protective member 216.

In the present embodiment, the protective member 216 is supported by the reflective member 214. In this way, the protective member 216 can be fixed to the reflective member 214 while the distance between the protective member 216 and the reflective member 214 is reliably maintained.

In the present embodiment, the reflective member 214 is supported by the holding member 215 that holds the contact member 212. In this way, the reflective member 214, the contact member 212, and the holding member 215 can be integrally formed. As a result, it is possible to compactify the configuration of the reflective member 214, the contact member 212, and the holding member 215 as a configuration in which the reflective member 214, the contact member 212, and the holding member 215 are mounted in the fixing film 211.

In the protective member 216, the bent portions 216*d* may be directly supported (fixed) at the holding member 215.

Second Embodiment

Figure 8:
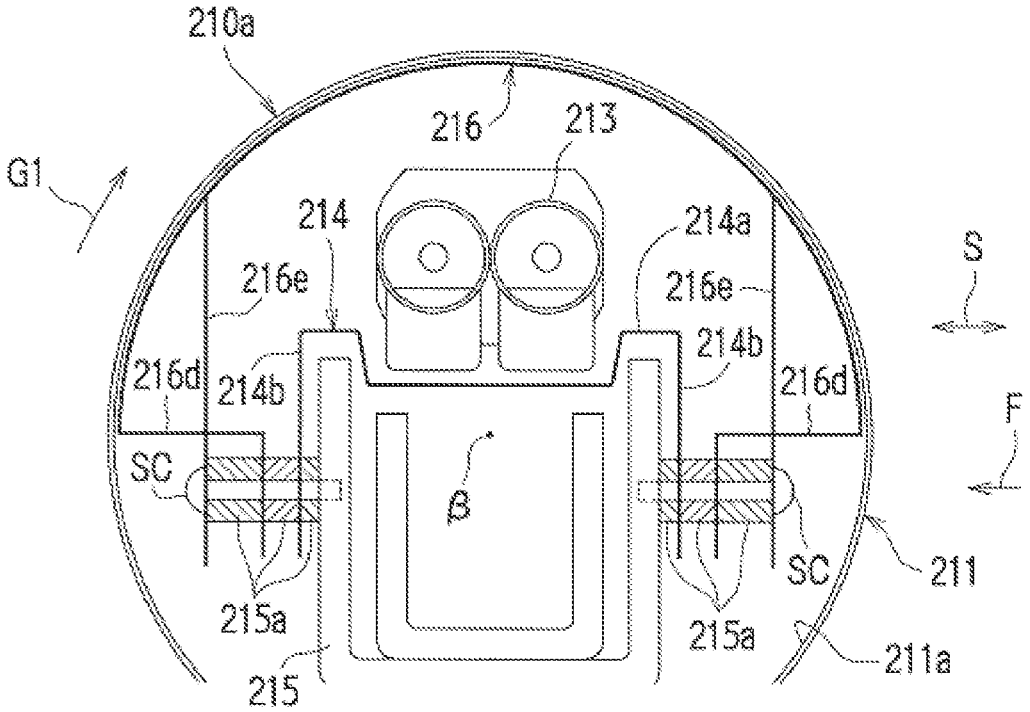
FIG. 8 is an enlarged cross-sectional view illustrating an enlarged heating fixer in the other example of the fixing device.

FIG. 8 is an enlarged cross-sectional view illustrating an enlarged heating fixer 210*a* in the other example of the fixing device 200.

When the thickness of the protective member 216 is small, the efficiency for heating the fixing film 211 by the heater 213 is improved, but the strength of the protective member 216 is lowered.

In this respect, in the present embodiment, as illustrated in FIG. 8, the protective member 216 is reinforced by reinforcing members 216*e*. In this way, the strength of the protective member 216 can be improved while the heating efficiency is improved. The reinforcing members 216*e* are provided on both sides of the protective member 216 in the short direction S. The reinforcing members 216*e* are fixed to the holding member 215 by a fixing member SC (screw) via the intervening members 215*a*.

Third Embodiment

Figure 9:
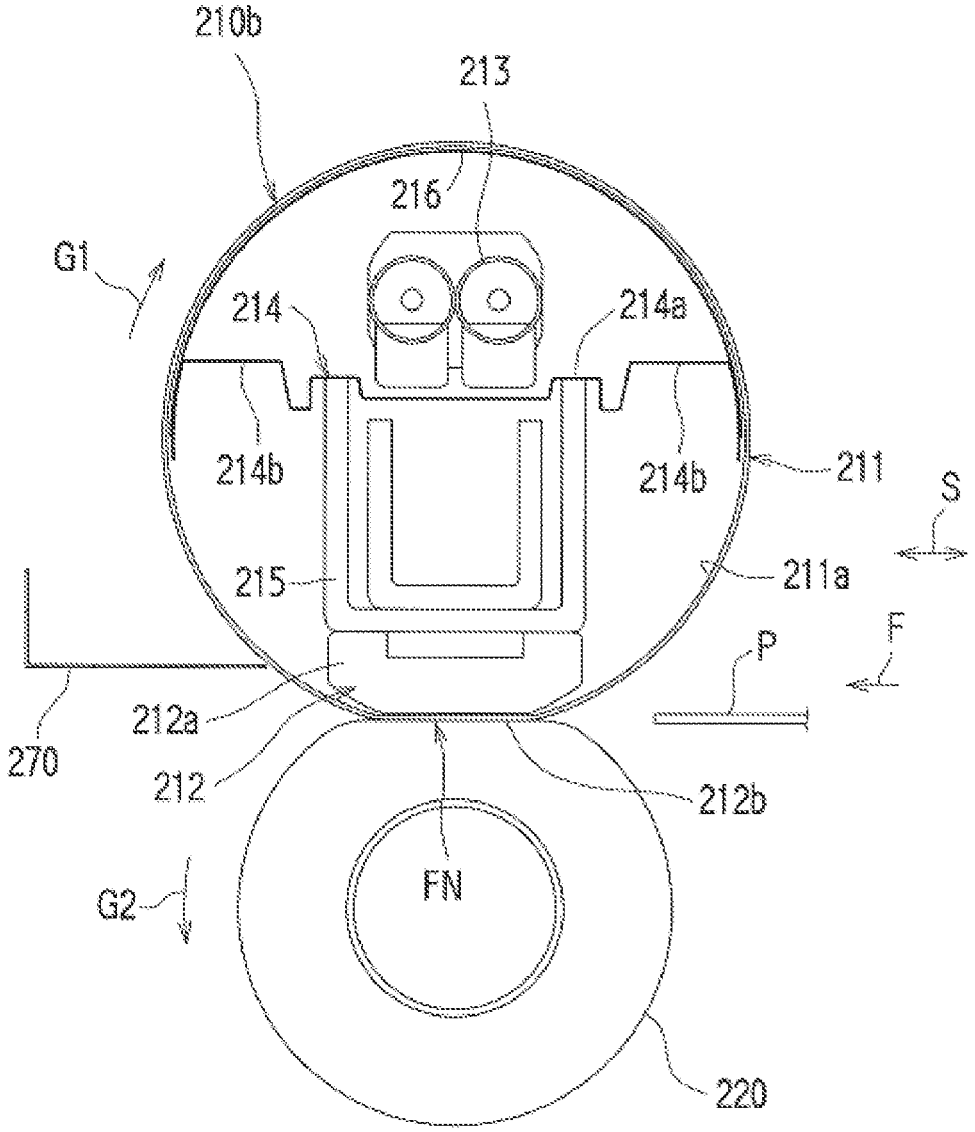
FIG. 9 is a cross-sectional view of the heating fixer and pressure roller portion in the yet another example of the fixing device.

FIG. 9 is a cross-sectional view of a heating fixer 210*b* and pressure roller 220 in the yet another example of the fixing device 200.

In the first embodiment and the second embodiment, the protective member 216 is supported by the reflective member 214 by the bent portions 216*d*. However, when the protective member 216 is formed with the bent portions 216*d*, the strength of the protective member 216 is lowered at the bent portions 216*d*, and the protective member 216 is easily damaged.

In this respect, in a third embodiment, the protective member 216 is supported (fixed) at the reflective member 214 and/or the holding member 215 (both in the illustrated example) at a portion (arc portion) facing the fixing film 211. In this way, the protective member 216 can be supported at the reflective member 214 and/or the holding member 215 without providing the bent portions 216*d*. As a result, it is possible to eliminate the portion where the strength of the protective member 216 is lowered. The support pieces 214*b* constituting the reflective member 214 extend on both sides in the short direction S. The support pieces 214*b* are fixed to the protective member 216 and the holding member 215 by a fixer such as welding.

The present invention is not limited to the embodiments described above, and can be implemented in other various forms. Therefore, the embodiments are merely examples in all respects and should not be limitedly interpreted. The scope of the present invention is indicated by the claims and is not bound by the text of the specification. Furthermore, all modifications and changes belonging to the equivalent range of the claims are within the scope of the present invention.

What is claimed is:

1. A fixing device comprising:

an endless fixing film that revolves;

a contact member that comes into contact with an inner peripheral surface of the fixing film;

a pressure roller that press-contacts the fixing film from outside the fixing film toward the contact member to form a fixing nip area between the fixing film and the pressure roller;

a heater that heats the fixing film;

a reflective member that reflects light emitted from the heater toward the fixing film; and a protective member that allows irradiation of the light toward the fixing film provided between the heater and the fixing film, the protective member provided closer to the fixing film than to the heater and is not in contact with both the heater and the fixing film.

2. The fixing device according to claim 1, wherein the protective member is provided with a plurality of through holes.

3. The fixing device according to claim 2, wherein a facing surface is formed between the plurality of through holes on a flat surface of a side of the protective member facing the fixing film.

4. The fixing device according to claim 2, wherein an opposite surface is formed between the plurality of through holes on a protruding curved surface of a side of the protective member opposite the fixing film.

5. The fixing device according to claim 1, wherein the protective member is formed in a mesh shape.

6. The fixing device according to claim 1, wherein at least a surface of the protective member facing the fixing film is formed of a high emissivity material having a higher emissivity than an emissivity of the reflective member.

7. The fixing device according to claim 1, wherein the heater is provided between the reflective member and the fixing film.

8. The fixing device according to claim 1, wherein the heater is provided on a side of an area opposite to the fixing nip area with respect to a revolution axis of the fixing film.

9. The fixing device according to claim 1, further comprising a holding member that holds the contact member, wherein the reflective member is supported by the holding member.

10. An image forming apparatus comprising the fixing device according to claim 1.

11. A fixing device comprising:

an endless fixing film that revolves;

a contact member that comes into contact with an inner peripheral surface of the fixing film;

a pressure roller that press-contacts the fixing film from outside the fixing film toward the contact member to form a fixing nip area between the fixing film and the pressure roller;

a heater that heats the fixing film;

a reflective member that reflects light emitted from the heater toward the fixing film; and a protective member that allows irradiation of the light toward the fixing film provided between the heater and the fixing film, the protective member provided to face the fixing film by half a circumference or more of the fixing film.

12. The fixing device according to claim 11, wherein the protective member is provided with a plurality of through holes.

13. The fixing device according to claim 11, wherein the protective member is not in contact with both the heater and the fixing film.

14. The fixing device according to claim 11, wherein the heater is provided between the reflective member and the fixing film.

15. An image forming apparatus comprising the fixing device according to claim 11.

16. A fixing device comprising:

an endless fixing film that revolves;

a contact member that comes into contact with an inner peripheral surface of the fixing film;

a pressure roller that press-contacts the fixing film from outside the fixing film toward the contact member to form a fixing nip area between the fixing film and the pressure roller;

a heater that heats the fixing film;

a reflective member that reflects light emitted from the heater toward the fixing film; and a protective member that allows irradiation of the light toward the fixing film provided between the heater and the fixing film, the protective member supported by the reflective member.

17. The fixing device according to claim 16, wherein the protective member is provided with a plurality of through holes.

18. The fixing device according to claim 16, wherein the protective member is not in contact with both the heater and the fixing film.

19. The fixing device according to claim 16, wherein the heater is provided between the reflective member and the fixing film.

20. An image forming apparatus comprising the fixing device according to claim 16.

* * * * *